175-48
9/20/83 OR 4,405,021

United States Patent [19]

Mumby

[11] 4,405,021

[45] Sep. 20, 1983

[54] APPARATUS FOR WELL LOGGING WHILE DRILLING

[75] Inventor: Edward S. Mumby, Carmichael, Calif.

[73] Assignee: Exploration Logging, Inc., Sacramento, Calif.

[21] Appl. No.: 302,446

[22] Filed: Sep. 15, 1981

Related U.S. Application Data

[63] Continuation-in-part of Ser. No. 211,501, Nov. 28, 1980, abandoned, which is a continuation of Ser. No. 21,348, Mar. 19, 1979, abandoned.

[51] Int. Cl.[3] ..... E21B 47/00

[52] U.S. Cl. ..... 175/48; 251/137

[58] Field of Search ..... 175/40, 48, 45; 367/83; 33/306; 251/137

[56] References Cited

U.S. PATENT DOCUMENTS

| | | | |
|---|---|---|---|
| 2,769,943 | 11/1956 | Matthews | 251/137 |
| 2,887,298 | 5/1959 | Hampton . | |
| 2,901,210 | 8/1959 | Hebard | 251/137 |
| 2,925,251 | 2/1960 | Arps | 251/137 X |
| 3,015,801 | 1/1962 | Kalbfell | 340/18 |
| 3,205,477 | 9/1965 | Kalbfell | 340/18 |
| 3,958,217 | 5/1976 | Spinnler | 340/18 LD |
| 3,964,556 | 6/1976 | Gearhart et al. | 175/45 |
| 3,983,948 | 10/1976 | Jeter | 175/45 |
| 4,078,620 | 3/1978 | Westlake et al. | 175/48 |
| 4,120,097 | 10/1978 | Jeter | 33/307 |
| 4,139,836 | 2/1979 | Chaney et al. | 340/18 NC |
| 4,181,184 | 1/1980 | Scherbatskoy | 175/65 |

FOREIGN PATENT DOCUMENTS

| | | |
|---|---|---|
| 2009473 | 6/1979 | United Kingdom . |
| 2066989 | 7/1981 | United Kingdom . |

OTHER PUBLICATIONS

Oil & Gas Journal, Jun. 12, 1978, p. 71, "Negative Pressure Pulse in MWD".

Oil & Gas Journal, Mar. 17, 1980, pp. 126–148, "MWD Update: New Systems Operating".

*Primary Examiner*—William F. Pate, III

*Attorney, Agent, or Firm*—Christie, Parker & Hale

[57] ABSTRACT

A monostable, solenoid-operated valve in a passage which bypasses the drilling fluid pressure drop across a drill bit at the lower end of a drill string in a well opens and closes in response to downhole conditions to create pressure pulses in the drilling fluid. The valve is urged toward a closed position by drilling fluid pumped through the drill string. A larger force is required to open the valve than to hold it open. Current supplied to the solenoid to open the valve is thereafter reduced to a value sufficient to hold the valve open. The solenoid is de-energized to close the valve.

29 Claims, 6 Drawing Figures

18
12
14
136
48
ELECTRONIC PROCESSING SYSTEM
SURFACE
46
44
20
40
22
41
DESURGER
24
38
MUD PUMP
26
16
43
36
42
28
10
30
32
34

55
575A
474
575B
456
450
646
646
42
580
578
32
582
576
583
574
575
582
581
586
570
573
575C
592
588
584
568
571
569
452
570
452
638
630
636
615
604
635
572
614
590
590
606
610
566
609
560
611
618
602
556
562
564
616
567
637
612
613
554
538
544
546
547
550
457
534
533
535
470
472
527
526
527
464
467
526
533
463
462
461
460
459
458

700
571
568
702
701
569
704
706
708
590

APPARATUS FOR WELL LOGGING WHILE DRILLING

CROSS-REFERENCE TO RELATED APPLICATIONS

This is a continuation-in-part of application Ser. No. 06/211,501, filed Nov. 28, 1980, now abandoned, which is a continuation of application Ser. No. 06/021,348, filed Mar. 19, 1979, now abandoned.

BACKGROUND OF THE INVENTION

1. Field of the Invention

This invention relates to the logging of wells during drilling, and more particularly to the wireless telemetry of data relating to downhole conditions.

2. The Prior Art

It has long been the practice to log wells, that is, to sense various downhole conditions within a well and transmit the acquired data to the surface through wire line or cable-type equipment. To conduct such logging operations, drilling is stopped, and the drill string is removed from the well. Since it is costly to stop drilling operations, the advantages of logging while drilling have long been recognized. However, the lack of an acceptable telemetering system has been a major obstacle to successful logging while drilling.

Various systems have been suggested for logging while drilling. For example, it has been proposed to transmit data to the surface electrically. Such methods have been impractical because of the need to provide the drill pipe sections with a special insulated conductor and appropriate connections for the conductor at the drill pipe joints. Other proposed techniques include the transmission of accoustical signals through the drill pipe. Examples of such telemetering systems are shown in U.S. Pat. Nos. 3,015,801 and 3,205,477. In those systems, an accoustical signal is sent up the drill pipe and frequency modulated in accordance with a sensed downhole condition.

Wireless systems have also been proposed using low-frequency electromagnetic radiation through the drill string, borehole casing, and the earth's lithosphere to the surface of the earth.

Other telemetering procedures proposed for logging while drilling use the drilling fluid within the well as the transmission medium. U.S. Pat. Nos. 2,925,251 and 3,964,556 disclose systems in which the flow of drilling fluid through the drill string is periodically restricted to cause positive pressure pulses to be transmitted up the column of drilling fluid to indicate a downhole condition. U.S. Pat. Nos. 2,887,298 and 4,078,620 disclose systems which periodically vent drilling fluid from the drill string interior to the annular space between the drill string and the borehole of the well to send negative pulses to the surface in a coded sequence corresponding to a sensed downhole condition. A similar system is described in *The Oil and Gas Journal*, June 12, 1978, at page 71.

Of the various wireless transmission systems considered to date, the most promising creates negative pressure pulses in the drilling fluid circulated through the drill string, drill bit, and borehole annulus. Negative pressure pulses are generated by intermittently bypassing a relatively small proportion of the total drilling fluid flow around the drill bit by opening and closing a valve in a passageway connecting the drill string interior with the borehole annulus.

A general problem with using pressure pulses in the drilling fluid to send information is that the pulse generators to date have been bulky and, therefore, impose a wasteful pressure drop in the drilling fluid flowing through the drill string. This invention provides a "slim" pulse generator which minimizes energy losses due to pressure drop in the drill string.

A specific problem with previous negative pulse generating systems is that if the valve in the bypass passage fails in the open position, energy of the drilling fluid is wasted, because part of the drilling fluid continuously bypasses the drill bit. Moreover, with the valve stuck in the open position, the abrasive nature of the drilling fluid may rapidly enlarge the bypass passage, with further waste of drilling fluid energy. Even more serious, a continuous, uncontrolled high-speed jet of drilling fluid out the side of the drill string may wash out a cavity in the well bore, leading to a possible cave-in and sticking of the drill string. Uncontrolled bypassing of drilling fluid also makes it difficult to place lost circulation material, or the like, in a desired position in the well bore, when the volume of fluid displaced through the drill bit must be accurately known.

Because of the disadvantages just referred to, bypass valves have not generally been trusted in oil well drilling operations. This invention provides a "fail-safe" bypass valve for generating negative pressure pulses in a manner which is safe, efficient, and reliable.

Another problem with valves used to generate pressure pulses in circulating drilling fluid is that the valve seats and valve disks, which open and close the valves, tend to wear rapidly because of the abrasive nature of the drilling fluid. Consequently, the valves usually need to be replaced much sooner and more often than the rest of the pulse-generating equipment in the drill string.

This invention provides a modular valve housing which can be quickly slipped into or out of operative engagement with the other equipment in the drill string, and provides superior valving action with longer life, because each valve seat and valve disk may be lapped into a specific fit to ensure a perfect seal, which increases valve operating service time.

SUMMARY OF THE INVENTION

The pulse generator of this invention includes a monostable valve in a passage which bypasses the drilling fluid pressure drop across a drill bit at the lower end of a drill string in a well. The valve opens and closes in a coded sequence in response to downhole conditions to create negative pressure pulses in the drilling fluid. The pulses may be generated and detected while drilling.

Means are provided to urge the valve from an open to a closed position, preferably by the pressure of the drilling fluid pumped through the drill string. A larger force is required to open the valve than to hold it open.

Preferably, the valve is actuated by a solenoid, which is first supplied enough current to open the valve. Thereafter, the current to the solenoid is reduced to a value just sufficient to hold the valve open to minimize power consumption. The solenoid is de-energized to close the valve. The opening and closing of the valve generates a negative pressure pulse in the drilling fluid to indicate a downhole condition.

In one form of the invention, the valve is urged to a closed position by a fluid catcher secured to a valve disk, which opens and closes the valve by moving away from or resting on a valve seat. Preferably, the fluid catcher is disposed on the low-pressure side of the valve seat.

In another form of the invention, a spring urges the valve disk toward the valve seat. Thus, when the flow of drilling fluid is stopped, or is relatively slow, the valve automatically closes, thereby preventing the bypass of drilling fluid around the drill bit during slow pumping operations, such as when lost circulation material is being "spotted" in a desired position.

In the preferred embodiment, the surface of the valve seat slopes inwardly in the direction of fluid flow at an angle of between about 5° and 40° to where the disk rests in a sealing position. The valve disk is undercut on the low-pressure side to provide rapid opening of the valve in response to slight movement of the disk away from the seat. The valve also includes a valve guide chamber on the high-pressure side of the seat. A piston connected to the disk makes a sliding seal in the chamber, and a pressure-balancing bore connects the interior of the valve guide chamber to the low-pressure side of the valve near where the valve disk engages the valve seat. The effective area or the piston acted on by the drilling fluid on the high-pressure side when the valve is closed is slightly less than that of the valve disk so a positive closing force is kept on the disk while the valve is closed. Preferably, the pressure-balancing bore extends through a valve stem which connects the piston to the valve disk to simplify construction and minimize the size of the pulse generator.

The valve is preferably operated by a solenoid shaft mounted to engage and lift the valve disk from the valve seat. A circuit supplies a relatively high current to the solenoid to generate enough force to open the valve. The force required to hold the valve open is substantially less than that required to open it. After the valve opens, the current to the solenoid is reduced to a value which generates a force just sufficient to overcome the closing force generated by the flow of fluid through the valve. The solenoid is subsequently de-energized so that the fluid flow through the valve (and the spring, if used) urges the valve to a closed position.

The solenoid is ordinarily surrounded by a liquid, such as oil or drilling fluid. To accelerate the action of the solenoid, the face plate of the solenoid is provided with shallow channels to facilitate the movement of fluid as the face plate moves toward and away from the solenoid core. Preferably, longitudinal bores extend through the face plate to further facilitate the surge of liquid as the solenoid is actuated.

In the preferred form of the invention, the solenoid is disposed in a housing filled with oil, and the solenoid shaft extends from a solenoid armature in the housing, and out through a floating piston, which keeps the pressure of the oil in the solenoid housing equal to the pressure of the drilling fluid surrounding the housing so that the solenoid is not subjected to extreme pressure differentials. The end of the solenoid shaft projecting through the floating piston from the solenoid housing is adapted to be operatively engaged by a valve stem operatively associated with a valve disk. The valve stem, valve disk, and valve seat are preferably enclosed in a modular valve housing which can slide longitudinally relative to the drill string so the valve housing can be slipped into the drill string into an operating position where the valve stem can be operatively engaged by the solenoid shaft. Means are provided for releasably locking the valve housing in the operating position in the drill string. Thus, the modular valve housing can be quickly released, removed, and replaced by a similar valve housing when operating conditions require it. Moreover, one valve housing can be substituted for another without disturbing the solenoid arrangement.

DESCRIPTION OF SPECIFIC EMBODIMENTS

In the preferred embodiments of the invention, as described in detail below, pressure pulses are transmitted through a drilling fluid to send information from the vicinity of a drill bit on the lower end of a drill string in a well to the surface of the earth as the well is drilled. At least one downhole condition within the well is sensed, and a signal, usually analog, is generated to represent the sensed condition. The signal controls the bypass of the flow of drilling fluid around the drill bit to cause pressure pulses at the surface in a coded sequence representing the downhole condition.

Figure 1:
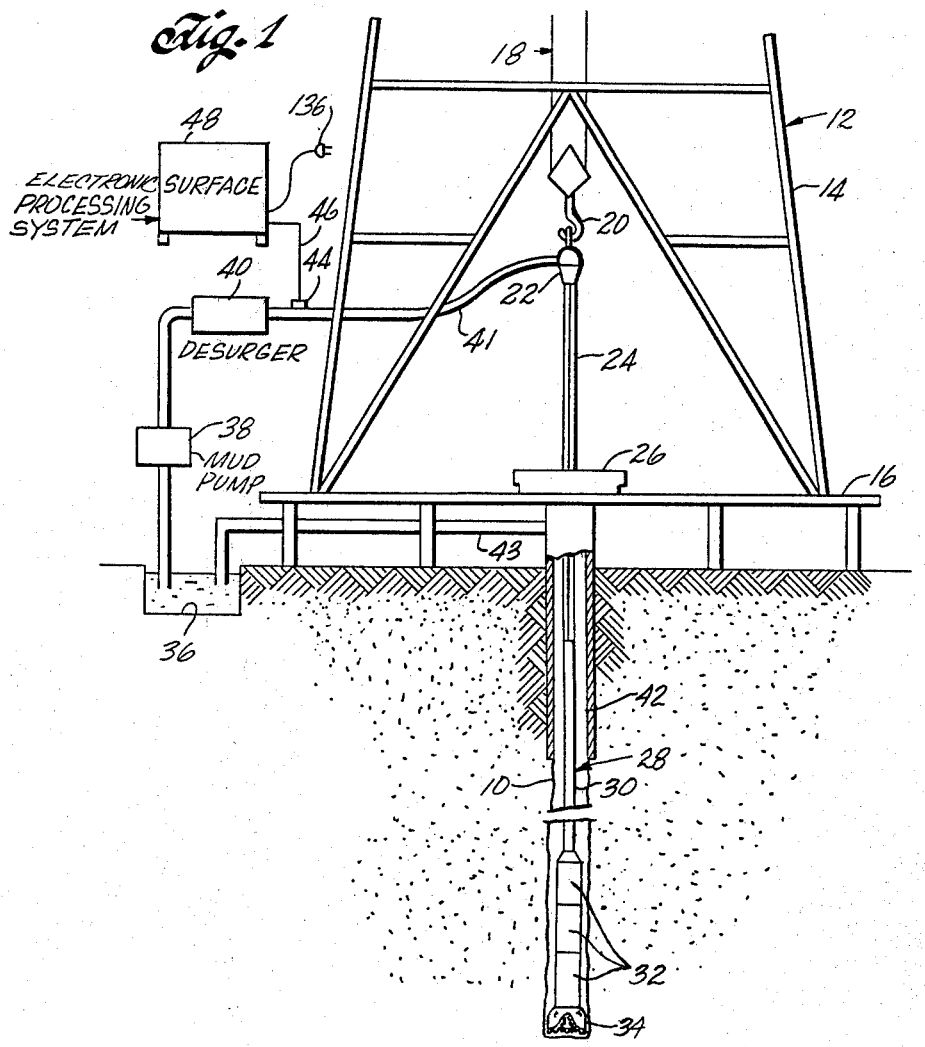
FIG. 1 shows a system for simultaneously drilling and logging a well.

Referring to FIG. 1, a well 10 is drilled in the earth with a rotary drilling rig 12, which includes the usual derrick 14, derrick floor 16, draw works 18, hook 20, swivel 22, kelly joint 24, rotary table 26, and a drill string 28 made up of drill pipe 30 secured to the lower end of the kelly joint 24 and to the upper end of a section of drill collars 32, which carry a drill bit 34. Drilling fluid (commonly called drilling mud in the field) circulates from a mud pit 36 through a mud pump 38, a desurger 40, a mud supply line 41, and into the swivel 22. The drilling mud flows down through the kelly joint, drill string and drill collars, and through nozzles (not shown) in the lower face of the drill bit. The drilling mud flows back up through an annular space 42 between the outer diameter of the drill string and the well bore to the surface, where it is returned to the mud pit through a mud return line 43. The usual shaker screen for separating formation cuttings from the drilling mud before it returns to the mud pit is not shown.

A transducer 44 in the mud supply line 41 detects variations in drilling mud pressure at the surface. The transducer generates electrical signals responsive to drilling mud pressure variations. These signals are transmitted by an electrical conductor 46 to a surface electronic processing system 48, such as that described in U.S. Pat. No. 4,078,620.

Figure 2:
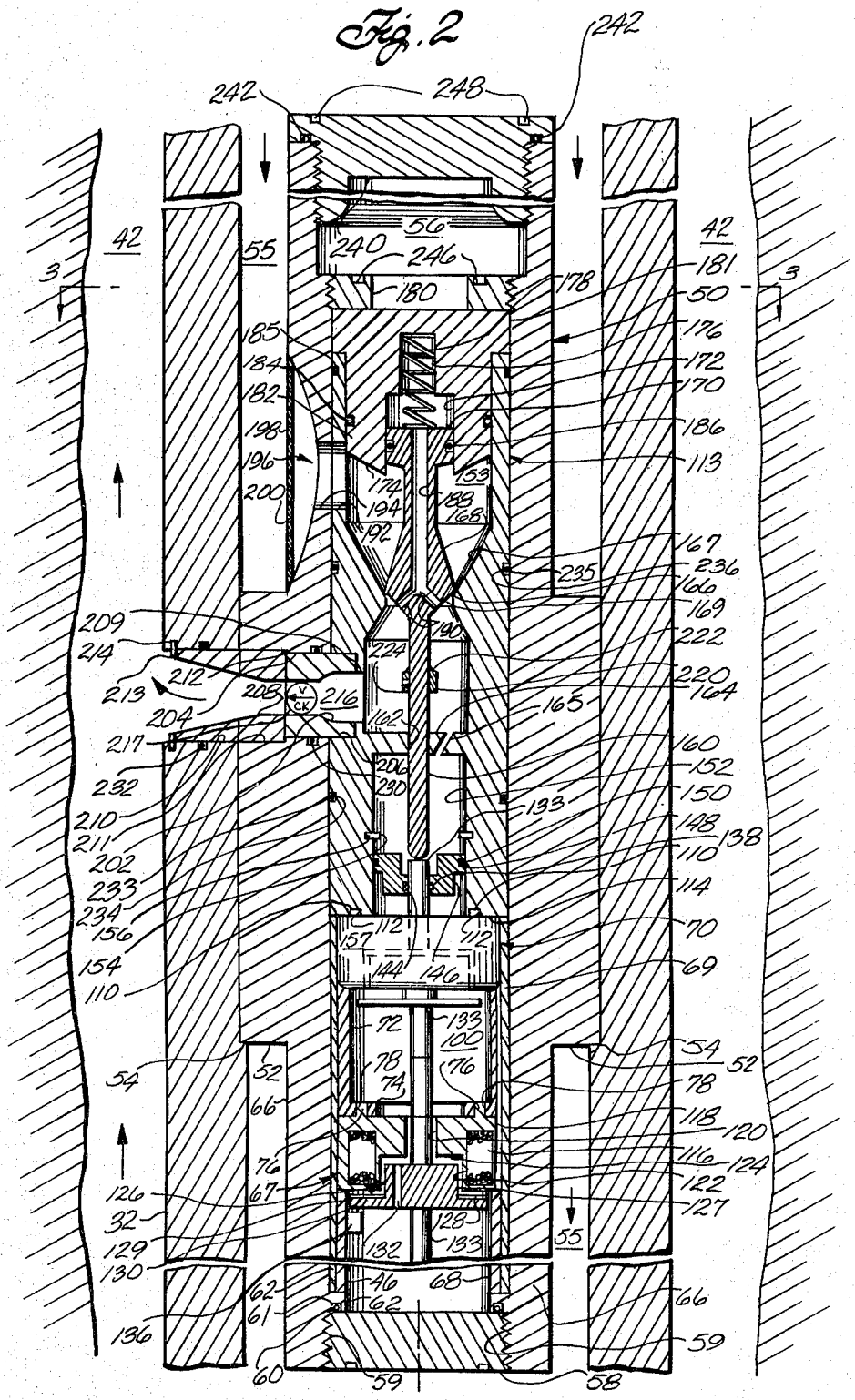
FIG. 2 is a schematic longitudinal cross-section of an embodiment of the pulse generator mounted in a drill string.

Referring to FIG. 2, an elongated, vertical, cylindrical pulser housing 50 includes a pair of outwardly extending fins or spiders 52 on diametrically opposite sides of the pulser housing. The spiders centralize the pulser housing within the drill collar and rest at their lower ends on inwardly extending shoulders 54 formed on the interior of the drill collar. Drilling fluid flows down an annular space 55 formed between the pulser housing and the drill collar, past the spiders, and out the drill bit nozzles (not shown), where it experiences a pressure drop of 1,000 to 3,000 p.s.i. in a typical drilling operation.

A central bore 56 extends longitudinally through the pulser housing. An externally-threaded plug 58, screwed into an internally-threaded section 59 at the lower end of the central bore, closes the bottom of the pulser housing. The plug seals against an O-ring gasket 60 in a downwardly opening annular groove 61 in the lower face of an inwardly extending annular shoulder 62 in the central bore 56 just above threaded portion 59.

A first, or lower, solenoid 67 rests on the upper end of a cylindrical lower solenoid spacer 68, which makes a snug fit within the lower end of a solenoid housing 69, which makes a snug fit within the pulser housing. The lower end of the solenoid spacer and the solenoid housing rest on the upper face of annular shoulder 62 at the lower end of the pulser housing. A second, or upper, solenoid 70 rests on the upper end of a cylindrical upper solenoid spacer 72, which has an inwardly extending annular flange 74 that rests on the upper surface of the lower solenoid. A pair of upwardly extending aligning pins 76 on the upper surface of the lower solenoid fit into respective vertical bores 78 in the inwardly extending flange 74. Upwardly extending aligning pins 110 on the upper face of the upper solenoid extend into aligning holes 112 in the bottom of a cylindrical valve assembly housing 113, which makes a snug fit within the pulser housing. The bottom of the valve assembly housing rests on the upper end of the solenoid housing and the top face of the upper solenoid.

Figure 3:
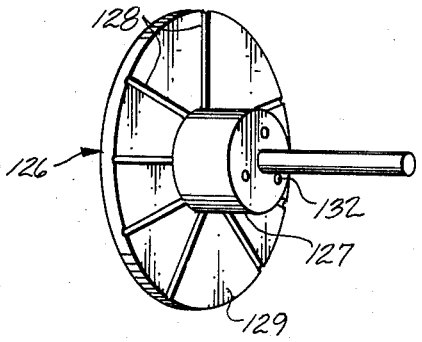
FIG. 3 is a perspective view of a solenoid face plate modified in accordance with this invention.

The two solenoids are identical, and may be conventional. Only the lower solenoid is shown in cross section. Each solenoid includes an annular solenoid winding or coil 116, through which electrical current is passed to create a strong magnetic field in an annular core 118, which has a relatively small central vertical bore 120 extending from its upper face to about the center of the core. The bore is then stepped outwardly to an enlarged diameter at 122 to form a downwardly facing internal shoulder 124. A cylindrical solenoid armature or face plate 126 includes a central cylindrical core 127, which makes a close, sliding fit within the enlarged portion 122 of bore 120. Radially extending channels 128 (FIG. 3) in the upper surface of an outwardly extending annular flange 129 on the lower end of the core of each face plate, and longitudinally extending bores 132 through each core permits the face plate to move freely in a body of oil (not shown) which surrounds the two solenoids. Each face plate carries a longitudinally extending central shaft 133, which projects above and below the face plate. The upper end of the solenoid shaft of the lower solenoid bears against the lower end of the solenoid shaft of the upper solenoid. The solenoids are energized simultaneously so that the solenoid face plates are driven upwardly together when the valve of this invention is to be opened. The two solenoids connected in tandem provide a strong face with a relatively small diameter required by the solenoids, thus permitting the pulser housing to be relatively small in diameter to minimize restriction of flow of drilling fluid past it. When the solenoids are de-energized, the outwardly extending annular flange 129 on the lower end of the core of the face plate of the lower solenoid rests on an inwardly extending limit switch 136 at the upper portion of the lower solenoid support sleeve 68. The limit switch and its operation are described in more detail below with respect to FIG. 4.

The upper end of the shaft of the upper solenoid makes a sliding fit through an O-ring seal 138 in a central bore 144 in a floating piston 146, which has an outwardly extending annular flange 148 with an annular O-ring seal 150 that makes a sliding seal against the inside of a reduced bore section 152 of a central bore 153 through the valve assembly housing. An inwardly extending C-ring 154 in an inwardly opening annular groove 156 just above the floating piston limits the upper travel of that piston, which forms the upper end of a solenoid chamber 157 filled with oil (not shown).

The lower end of a vertical valve stem 160 bears against the upper end of the upper solenoid shaft. The valve stem extends up through a bore 162 in a transverse partition 164 which extends across the central bore of the valve assembly housing. A vent 165 through the partition equalizes fluid pressure on opposite sides of the partition. The intermediate portion of the valve stem is enlarged to form an annular valve disk 166, which normally rests on an annular valve seat 167, formed integrally with the interior wall of the valve housing assembly. The valve seat includes an upwardly and outwardly sloping conical wall inclined at an angle between about 20° and about 30° from the centerline of the valve stem.

The valve disk includes a downwardly and outwardly sloping upper conical surface 168, the lower edge of which rests on the valve seat. The valve disk extends inwardly and horizontally for a short distance from the line of contact the valve disk makes with the valve seat, and then extends downwardly and inwardly along a second conical surface 169. This provides a sharp and rapidly opening orifice as the valve disk is lifted slightly off the valve seat, and thereby facilitates movement of drilling fluid around the edge of the valve disk once it has moved marginally off the seat. This action minimizes the force required to open the valve.

A valve stem piston 170 on the upper end of the valve stem makes a close sliding fit within a downwardly opening cylindrical valve guide chamber 172 in the lower face of a cylindrical upper guide 174 for the valve stem. The upper portion of the valve guide chamber 172 is stepped down to a reduced diameter section 176 to receive the upper end of a compression spring 178, the lower end of which bears down against the top surface of the valve stem piston.

A main lock-ring 180, threaded into the upper end of the valve assembly housing central bore, holds an outwardly extending flange 181 on the upper valve guide in compression against the upper end of the valve assembly housing. An annular O-ring seal 184 around the exterior of the upper valve guide makes a fluid-tight seal against the interior of the valve assembly housing. An annular O-ring seal 185 at the upper end of the valve assembly housing makes a fluid-tight seal against the interior of the pulser housing.

An annular O-ring seal 186 on the valve stem piston makes a fluid-tight sliding seal within the wall of the valve guide chamber. A pressure-balancing bore or channel 188 extends longitudinally through the piston and upper portion of the valve stem down to a point just below the valve disk 166. The lower end of bore 188 branches out into two lateral bores or channels 190, which each open into the central bore of the valve assembly housing just below the valve seat so that pressure on the low-pressure side of the valve disk when the valve is closed is transmitted to the upper surface of the valve stem piston. The effective area of the valve stem piston acted on by the pressure of the drilling fluid in the valve is slightly less than that of the valve disk to balance the pressure across the disk to a relatively small, but steady, force which tends to hold the disk down on the valve seat. That force is equal to the differential pressure multiplied by the difference in the effective cross section areas of the piston and the valve disk. By using the internal bore in the valve stem, instead of passages through the pulser housing or valve assembly housing, the diameter of the pulser housing is set by the diameters of the solenoids, which may be relatively small because the two solenoids work together.

A lateral bore 192 through the wall of the valve assembly housing is aligned with a bore 194 through the wall of the pulser housing to form a valve inlet 196 for drilling fluid from the annular space 55 between the pulser housing exterior and the drill collar interior. A screen 198 over the valve inlet prevents the entry of large solid particles into the valve. A plurality of upwardly and inwardly inclined bores 200 in the screen minimize the entry of solid particles into the valve.

An inner exhaust nozzle 202 fits in collinear matching bores 204 and 206 in the pulser housing wall and valve assembly housing wall, respectively. The inner end of the inner nozzle bears against an annular shoulder 209 formed where bore 206 is reduced in diameter. Preferably, the inner nozzle is of reduced diameter in an outwardly extending direction. An outer exhaust nozzle 208 fits in a bore 210 through the wall of the drill collar and collinear with a bore 211 through the spider on the left (as viewed in FIG. 2) side the pulser housing. Bores 210 and 211 are collinear with, and slightly larger than, bores 204 and 206 so the inner end of the outer nozzle bears against a shoulder 212 at the juncture of bores 204 and 211. Preferably, the outer exhaust nozzle increases in diameter in an outward direction. A retaining ring 213 in an annular groove 214 at the outer end of bore 210 holds the exhaust nozzles in place. The exhaust nozzles 202 and 208 form a valve outlet 216 for fluid when the valve is open. A check valve 217 in nozzle 202 prevents the flow of fluid from the well bore annulus into the valve, such as when reverse circulation may be imposed on the drilling fluid.

An outwardly extending fluid catcher 220, in the form of an annular ring with an inwardly and upwardly sloping surface 222, is secured to the valve stem by a set screw 224 at about the same level as the upper portion of the valve outlet. Alternatively, the fluid catcher may be formed integrally with the valve stem.

An annular O-ring seal 230 in the bore 204 makes a fluid-tight seal around the inner exhaust nozzle, and an annular O-ring seal 232 in the bore 210 makes a fluid-tight seal around the outer exhaust nozzle.

An O-ring 233 in an annular groove 234 in the outer face of the valve housing wall makes a fluid-tight seal against the interior surface of the pulser housing exterior 66 above the upper end of the solenoid housing. An O-ring 235 in an annular groove 236 in the outer face of the valve assembly housing makes a fluid-tight seal against the interior surface of the pulser housing between the valve inlet and outlet.

The upper end of the pulser housing is sealed by a cap 240 threaded into the pulser housing. An annular O-ring 242 in the lower face of the cap seals against the upper end of the pulser housing to make a fluid-tight seal.

Upwardly opening recesses 246 in the upper surface of the main lock-ring for the valve assembly housing permit the main lock-ring to be screwed tightly into place or removed, as required. Similar recesses 248 in the upper surface of the cap 240 permit it to be installed or removed, as required.

Thus, with the pulser housing mounted in the drill collar as shown in FIG. 2, drilling fluid flows as indicated by the arrows down the annular space between the pulser housing and the drill collars, into the valve inlet, and, when the valve is open, out the valve outlet, thereby bypassing some of the fluid flow around the drill bit at the lower end of the drill string. The drilling fluid which does not pass through the valve continues to flow down past the pulser housing and out through the drill bit.

Although FIG. 2 shows the valve inlet and valve outlet in the same vertical plane, more than one inlet or outlet can be provided, and they need not be in the same vertical plane. For example, the valve assembly housing may include two inlets (not shown) on opposite sides of the valve assembly housing, with a single valve outlet centered between the two inlets.

A power source (not shown in FIG. 2), such as a battery or a generator (not shown) driven by a turbine (not shown) through which drilling fluid flows, may be mounted in the pulser housing.

Figure 4:
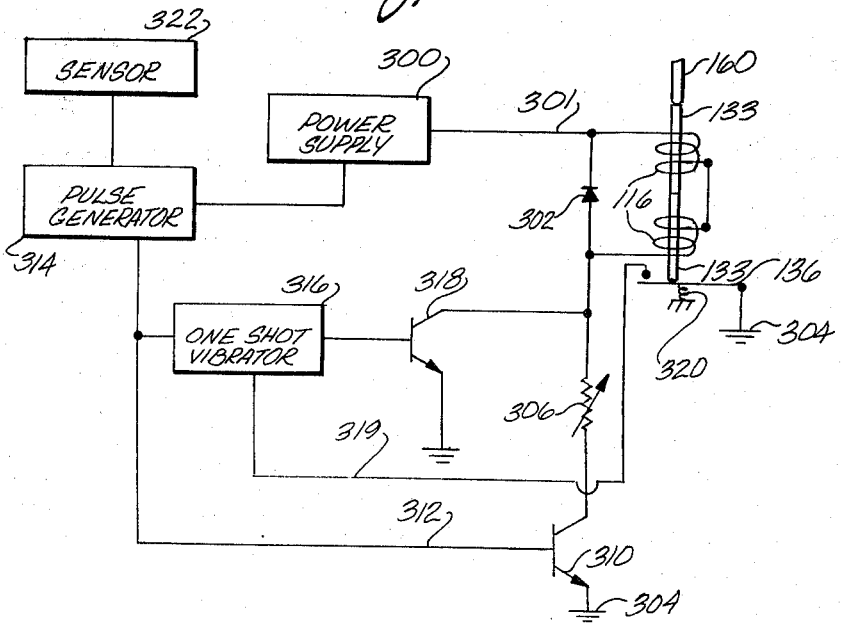
FIG. 4 is a schematic diagram of a circuit used to control current through one or more solenoids for operating the pulse generator.

The valve opens and closes in response to electrical signals developed by the circuit shown in FIG. 4. The circuit may be in a sealed chamber (not shown) within the pulser housing. For clarity, the electrical leads between the power source, the electronic circuitry, and the solenoids are not shown in FIG. 2.

Referring to FIG. 4, a power supply 300 supplies current through a first conductor 301 to the solenoid coils 116 connected in series, and across which is connected a diode rectifier 302. The solenoid coils 116 are connected to ground 304 through a rheostat 306 and a first transistor 310, the base of which is connected by conductor 312 to the output of a pulse generator 314. The input of a one-shot vibrator 316 is connected to the output of the pulse generator, and the output of the one-shot vibrator is connected to the base of a second transistor 318, the collector of which is connected to the end of the solenoid coils remote from the power source. The emitter of the second transistor is grounded to provide a low resistance path for current through the solenoid windings. The R-C components (not shown) in the one-shot vibrator are connected by a line 319 to a contact of switch 136, which is open when the valve is closed. A compression spring 320 closes the switch when the valve opens thereby grounding the R-C components to stop the pulse from the one-shot vibrator.

A sensor 322 (normally mounted in the drill collar near the drill bit) detects a downhole condition, such as formation electrical resistivity, mud temperature, mud pressure, weight on drill bit, natural radioactivity of the formation, inclination of the borehole, or the like. The pulse generator delivers a coded sequence of pressure pulses in response to signals received from the sensor.

When the valve is to be opened and closed to generate a negative pulse in the drilling fluid, the pulse generator applies a long, say, 500 milliseconds, pulse to the input of the one-shot vibrator and to the base of the first transistor. The one-shot vibrator applies a short pulse to the base of the second transistor, causing it to conduct d.c. electrical power from the power supply, through the solenoid coil windings, and to ground.

The pulse from the one-shot vibrator lasts until the valve opens. At that time the lower solenoid flange moves away from switch 136, which closes and turns off the one-shot vibrator, causing the second transistor to stop conducting. The switch may be of any suitable type, such as a limit switch, proximity detector, magnetic switch, or the like. Alternatively, the switch may be omitted, and the vibrator set to provide a pulse of fixed duration, say, 40 milliseconds, which is ordinarily sufficient time for the valve to open. The duration of the short pulse is substantially less than that of the long pulse. For example, the short pulse duration is between about 1% and about 50% of that of the long pulse.

The resistance of the circuit through the second transistor is low so that a relatively large current of 4 to 5 amps flows through the solenoid coil windings, generating a sufficiently large force on the solenoid armatures that the solenoid shafts are driven upwardly to lift the valve disk off its seat, thereby permitting drilling fluid to flow from the annular space between the pulser housing and drill collar, through the valve, and into the annular space between the drill collar and well bore.

The diode connected across the solenoid coils permits "free wheel" current to flow through them as the large current drops to the lower value. This provides additional force without drawing energy from the power source, and helps hold the valve open, if it should tend to "bounce" closed.

After the second transistor stops conducting, current continues to flow through the rheostat 306 and the first transistor 310 until the long pulse from the pulse generator terminates. The variable resistor is set so that the current flowing through the solenoid coil windings after the pulse from the one-shot vibrator has ended is just sufficient to hold the valve open against the pressure exerted by drilling fluid flowing through it against the fluid catcher. Once the solenoid is de-energized, the force exerted by the drilling fluid on the fluid catcher forces the valve stem down so that the valve disk comes to rest on the valve seat, thereby preventing further bypass of drilling fluid around the drilling bit, and completing a negative pressure pulse, which may be detected at the surface.

Since the area of the valve stem piston is slightly less than that of the valve disk, a relatively small, but steady, force is applied on the upper side of the valve disk when the valve is closed. Ordinarily, the pressure drop across the drill bit is between about 1000 and about 3000 pounds per square inch, but with the pressure-balancing bore in the valve stem, the force on the valve disk in the closed position is only 30 to 50 pounds, thereby permitting the valve to be opened with a relatively small force. It is held open with an even smaller force. For example, the current through the solenoid windings after the second transistor stops conducting is substantially less than, and usually only about ten percent of, that required to open the valve. Ordinarily, the holding current is between about 1% and about 50% of the opening current.

The amount of current required to hold the valve in the open position depends on the shape, size, and location of the fluid catcher. In a valve in which the diameter of the valve seat is about $\frac{3}{4}$ inch, and the maximum diameter of the catcher is about 0.6 inch, the minimum holding current is produced when the catcher is between about $\frac{1}{4}$ and about $\frac{3}{4}$ inch below the line where the valve disk contacts the valve seat.

The two solenoids acting in tandem and simultaneously in the same direction provide a large lifting force, and yet are smaller in diameter than a single solenoid which would supply the same force with the same current. Accordingly, the pulser housing can be made relatively slim to minimize pressure drop in the drilling fluid as it flows down the drill string.

Another advantage of the two solenoids working together is that the solenoid shafts and valve stem work together by simple abutment without requiring any complicated linkages which could break, jam, or permit misalignment, during operation.

Moreover, the monostable valve cannot be bounced into a permanently open position, as can happen with a bistable valve. Therefore, the balanced force keeping the valve closed can be lower, resulting in a lower opening force. This, of course, permits the use of smaller solenoids and requires less power for operation.

The spring 178 urging the valve disk into the closed position is not essential to the operation of the valve, although it is useful in those situations where the valve might tend to remain open under low flow conditions. For example, if cement is being placed in the well by displacing it downwardly during slow operation of the drilling pump, the accuracy of the placement is improved if the valve is closed so that no drilling fluid can bypass the drill bit. In such a situation, the spring would ensure that the valve is closed.

If used, the spring is chosen so that it does not substantially affect the force required to open the valve. The spring is not intended to supplement the force produced by the fluid catcher on the valve stem. It is present only to provide a steady minimum closing force under slow or no-flow conditions for the drilling fluid.

The fluid catcher can be omitted, if the valve disk is shaped and located so the flow of drilling fluid through the open valve produces the desired closing force after the solenoids are de-energized.

Venting bore 165 permits the application of drilling fluid pressure against the top of the floating piston 146 so that the oil in the solenoid chamber remains fully pressurized to reduce any tendency for drilling fluid to leak into the solenoid chamber.

The radial channels 130 and the bores 132 in the solenoid face plates facilitate surging of the oil and free movement of the solenoid face plates as the solenoids are energized and de-energized.

Those surfaces of the valve which are exposed to the abrasive action of flowing drilling fluid are preferably made of an abrasion-resistant material, such as tungsten carbide or titanium carbide, to ensure long life.

Figure 5:
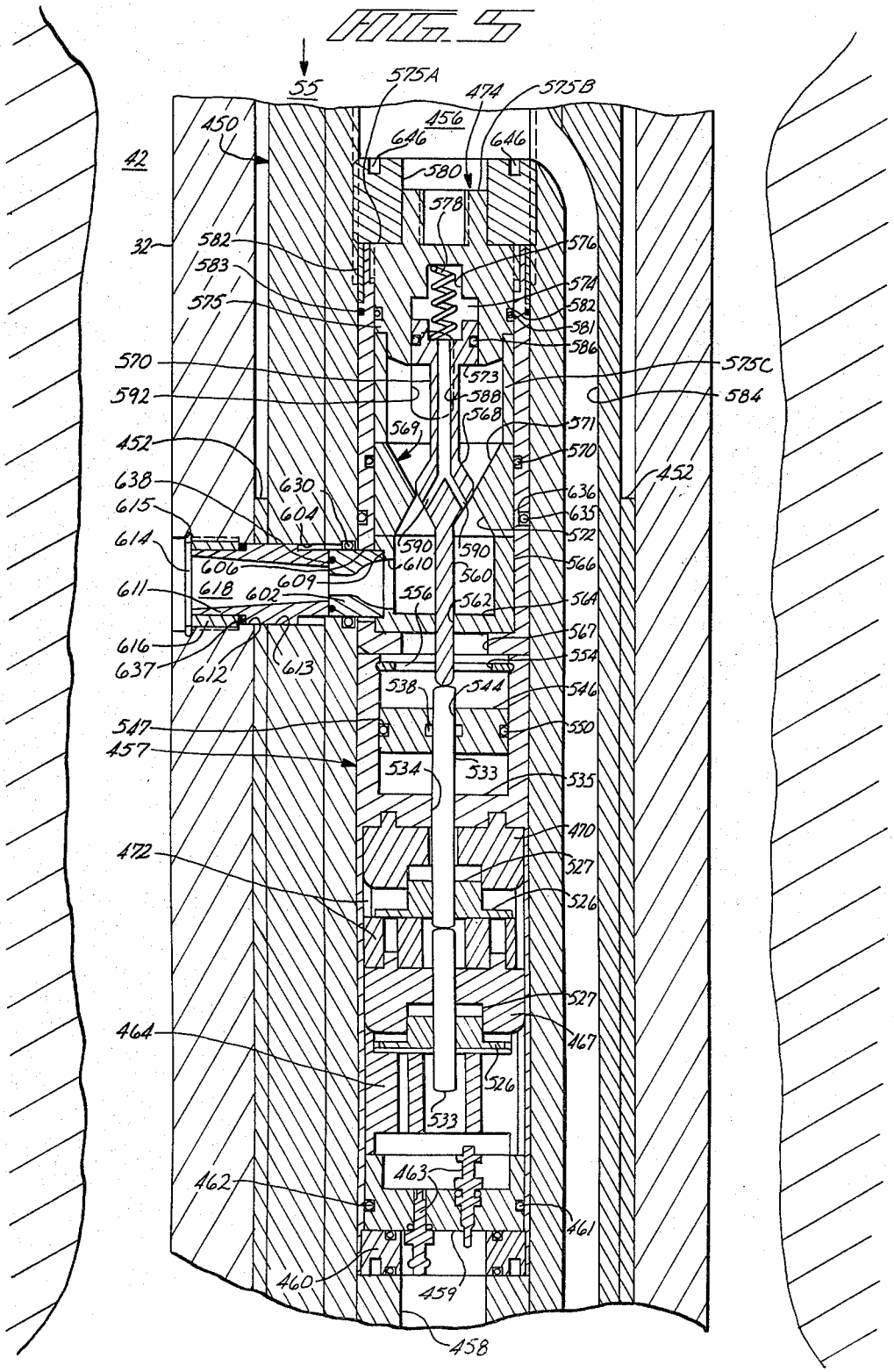
FIG. 5 is a fragmentary, schematic, longitudinal cross section of a presently preferred embodiment of the pulse generator mounted in a drill string so the valve can be replaced without disturbing the solenoid assembly.

Referring to FIG. 5, which shows the presently preferred embodiment of the invention, an elongated, vertical, cylindrical pulser housing 450 includes a pair of elongated, outwardly extending fins or spiders 452 on diametrically opposite sides of the pulser housing. The spiders centralize the pulser housing within the drill collar 32, and rest to their lower ends on an inwardly extending shoulder (not shown) formed on the interior of the drill collar, as shown and described above with reference to FIG. 2. Drilling fluid flows down an annular space 55 between the pulser housing and the drill collar, past the spiders, and out the drill bit nozzles (not shown), where it undergoes a pressure drop of 1,000 to 2,000 psi in a typical drilling operation.

A central bore 456 extends longitudially through the pulser housing, the lower end (not shown) of which is closed as described above with respect to the pulser housing shown in FIG. 2.

The lower end of a solenoid housing 457 rests on the upper end of a control circuit housing 458 in the pulser central bore. The control circuit housing 458 rests on the bottom closure for the pulser housing, and is not described in detail, because it forms no part of the present invention.

A plug 459 closes the lower end of the solenoid housing and is held in place by an externally threaded retainer 460 screwed into the lower end of the solenoid housing. An O-ring 461, in an outwardly opening external groove 462 around the periphery of the plug 459, makes a fluid-tight seal between the plug and the interior surface of the lower end of the solenoid housing. Standard circuit feed-through devices 463 are sealed through the plug 459 for controlling operation of the solenoids, as described in detail above with reference to FIGS. 2 and 4.

A cylindrical first spacer 464 rests on the upper end of the plug 459. A first, or lower, solenoid 467 in the solenoid housing rests on the upper end of the first spacer 464. A second, or upper, solenoid 470 rests on the upper end of a second cylindrical spacer 472, the lower end of which rests on the upper surface of the lower solenoid.

The bottom of a cylindrical valve housing 474 rests on the upper end of the solenoid housing.

As with the embodiment shown in FIG. 2, the two solenoids may be identical and may be conventional. Each solenoid includes an annular solenoid winding or coil (not shown), through which electrical current is passed to create a magnetic field in an annular core (not shown in detail). A cylindrical solenoid armature or face plate 526 includes a central cylindrical core 527, which makes a close, sliding fit within the annular core of the solenoid. Each armature or face plate carries a longitudinally extending solenoid shaft 533, which projects above and below the solenoid. The upper end of the solenoid shaft of the lower solenoid bears against the lower end of the solenoid shaft of the upper solenoid. The solenoids are energized simultaneously so that the solenoid face plates are driven upwardly together when the valve of this invention is to be opened. The two solenoids connected in tandem provide a strong force with a relatively small diameter required by the solenoids, thus permitting the pulser housing to be relatively small in diameter to minimize restriction of flow of drilling fluid past it. When the solenoids are de-energized, the outwardly extending portion of the face plate of the lower solenoid contacts a limit switch (not shown), which operates as described above in detail with respect to FIG. 4.

The upper end of the upper solenoid shaft makes a loose sliding fit through a vertical bore 534 in a transverse wall 535 extending across the interior of the solenoid housing. The extreme upper end of the upper solenoid shaft makes a sliding fit through an O-ring seal 538 in a central bore 544 in a floating piston 546, which has an outwardly opening annular groove 547 that carries an O-ring 550 that makes a sliding seal against the inside surface of the upper portion of the solenoid housing. The solenoid housing is filled with oil from the plug 459 to the floating piston 546, which keeps the oil pressure equal to that of the surrounding drilling fluid so the solenoids operate without any extraneous pressure differentials.

An inwardly extending C-ring 554 in an inwardly opening annular groove 556 just above the floating piston limits the upper travel of that piston.

The lower end of a vertical valve stem 560 bears against the upper end of the upper solenoid shaft. The valve stem extends upwardly to make a close sliding fit through a central bore 562 in a transverse partition 564 across the bottom of a cylindrical lower valve housing spacer 566, which rests on the upper surface of an inwardly extending annular flange 567 that forms the lower end of the valve housing 474 that rests on the upper end of the solenoid housing.

The intermediate portion of the valve stem is enlarged to form an annular valve disk 568, which normally rests on an annular valve seat 569, the lower end of which rests on the upper edge of the lower valve housing spacer 566. An O-ring 570 in an inwardly opening annular groove on the interior surface of the valve housing wall makes a seal against the exterior surface of the annular valve seat 569. The valve seat includes an upwardly and outwardly sloping conical wall 517 (at a subtended angle between about 15° and about 25° with respect to the centerline of the valve stem) where the valve disks rest on the seat with the valve closed. The seating of the valve disk on the valve seat is described in more detail below with respect to FIG. 6. The valve seat also includes a conical wall 572, which slopes downwardly and outwardly (at a subtended angle between about 15° and about 25° with respect to the valve stem centerline) below where the valve disk rests on the seat with the valve closed.

A valve stem piston 573 on the upper end of the valve stem makes a close sliding fit within a downwardly opening cylindrical valve guide chamber 574 in the lower face of an upper cylindrical guide 575 for the valve stem. The guide 575 is externally threaded and is screwed into an internally threaded section at the upper end of the valve housing so an annular shoulder 575A is flush with the upper end of the valve housing. An annular boss 575B, formed integrally with the top surface of the guide 575, is internally threaded to receive a threaded handle (not shown), which may be used to pull the valve housing and associated elements out of the pulser housing. The guide 575 bottoms on the upper end of an upper cylindrical valve housing spacer 575C, the lower end of which bears against the upper end of the valve seat 569. The upper portion of the valve guide chamber 575 is stepped down to a reduced diameter section 576 to receive the upper end of a compression spring 578, the lower end of which bears down against the top surface of the valve stem piston.

A locking ring 580, threaded into the upper end of the pulser housing, locks the valve housing, solenoid housing, and the circuit housing 578 firmly in operating position in the drill collar, as shown in FIG. 5.

An O-ring 581 in an outwardly opening annular groove around the exterior of the cylindrical upper guide 574 makes a fluid-tight seal against the interior of the valve housing.

A section of the upper end of the valve housing is of reduced diameter to receive a sleeve 582, which compresses an O-ring 583 resting on an annular shoulder formed where the reduced diameter section stops. The locking ring 580 holds the sleeve 582 and O-ring 583 in compression to make a seal which prevents drilling mud from entering a longitudinally extending wire passage 584 in the pulser housing.

An annular O-ring seal 586 on the valve stem piston makes a fluid-tight sliding seal against the interior surface of the valve guide chamber wall.

A pressure-balancing bore or channel 588 extends longitudinally through the piston and upper portion of the valve stem down to a point just below the valve disk 568. The lower end of channel 588 branches out into two lateral bores or channels 590, which each open into the central bore of the valve housing just below the valve seat so that pressure on the low-pressure side of the valve disk, when the valve is closed, is transmitted to the upper surface of the valve stem piston in the chamber 574. The effective area of the valve stem piston acted on by the pressure of the drilling fluid in the valve is slightly less than that of the valve disk to balance the pressure across the disk to a relatively small, but steady, force, which tends to hold the valve disk down on the valve seat. That force is equal to the differential pressure multiplied by the difference to the effective cross sectional areas of the piston and the valve disk. By using the internal bore in the valve stem, instead of passages through the pulser housing or valve housing, the diameter of the pulser housing is set by the diameters of the solenoids, which may be relatively small because the two solenoids work together.

A lateral bore 592 through the wall of the valve housing is aligned with a bore (not shown) through the wall of the pulser housing to form a valve housing inlet for drilling fluid from the annular space 55 between the pulser housing exterior and the drill collar interior. A screen (not shown) over the valve inlet prevents entry of large solid particles into the valve. As with the inlet 196 described above with respect to the apparatus shown in FIG. 2, a plurality of upwardly and inwardly inclined bores (not shown) in the screen over the inlet minimize the entry of solid particles into the valve.

An inner exhaust nozzle 602 fits in collinear and horizontal matching bores 604 and 606 in the pulser housing wall and valve housing wall, respectively. The inner end of the inner nozzle bears against an annular shoulder 609 formed where a bore 610 through the wall of the lower spacer in the valve housing is aligned with the bores 604 and 606. The nozzle is of reduced diameter in an outwardly extending direction. An outer diffuser 611 fits in a bore 612 through the wall of the drill collar and collinear with a bore 613 through the spider on the left (as viewed in FIG. 5) of the pulser housing. Bores 612 and 613 are collinear with bores 604 and 606. The inner end of the diffuser bears against the outer end of the nozzle. The diffuser increases in diameter in an outwardly extending direction.

A retaining ring 614 in an annular groove 615 at the outer end of bore 612 secures a locking ring 616 screwed into a threaded section of bore 612 to hold the diffuser and nozzle in compression against the annular shoulder 609 of the lower spacer in the valve housing. Exhaust nozzle 602 and the diffuser 611 form a valve housing outlet 618 for fluid when the valve is open.

An annular O-ring seal 630 in the bore 604 makes a fluid-tight seal around the inner exhaust nozzle.

An O-ring 635 is an annular groove 636 in the outer surface of the valve housing makes a fluid-tight seal against the interior surface of the pulser housing between the valve housing inlet and outlet.

An O-ring 637, between the diffuser and the locking ring, and another O-ring 638, between the inner end of the diffuser and the outer end of the nozzle, prevent leakage of drilling fluid from the drill string interior to the exterior.

The upper end of the pulser housing is closed by a cap (not shown) in a manner similar to that described above with respect to the apparatus shown in FIG. 2.

Upwardly opening recesses 646 permit the lock ring 580 to be screwed tightly into place or removed, as required. Similar recesses (not shown) in the outer surface of locking ring 616 at the outer end of the diffuser permit ring 616 to be screwed into position or removed, as required. Thus, with the upper end of the pulser housing open, the lock ring 580 can be removed, and so can the retaining ring 614, locking ring 616, the diffuser 611, and nozzle 602. This leaves the valve housing free to slide longitudinally relative to the drill string and out of the pulser housing so the valve housing can be quickly removed and replaced with another, if the valve becomes worn through use, or inoperative for any other reason. Moreover, the removal of one valve housing and replacement with another can be done without disturbing the solenoid housing or any equipment below it.

With the pulser housing mounted in the drill collar, as shown in FIG. 5, drilling fluid flows as indicated by the arrows down the annular space between the pulser housing and drill collars, into the valve housing inlet, and, when the valve is open, out the valve housing outlet, thereby bypassing some of the fluid around the drill bit around the lower end of the drill string. The drilling fluid which does not pass through the valve continues to flow down past the pulser housing and out through the drill bit.

As with the apparatus described with respect to FIG. 2, a power source (not shown in FIG. 5), such as a battery or a generator (not shown), driven by a turbine (not shown) through which drilling fluid flows, may be mounted in the pulser housing.

The valve shown in FIG. 5 opens and closes in response to electrical signals developed by the circuit shown in FIG. 4. That operation is described above with respect to FIGS. 2 and 4 and is not repeated here for brevity. For simplicity, the electrical leads between the power source, the electronic circuitry, and the solenoids are not shown in FIG. 5.

Figure 6:
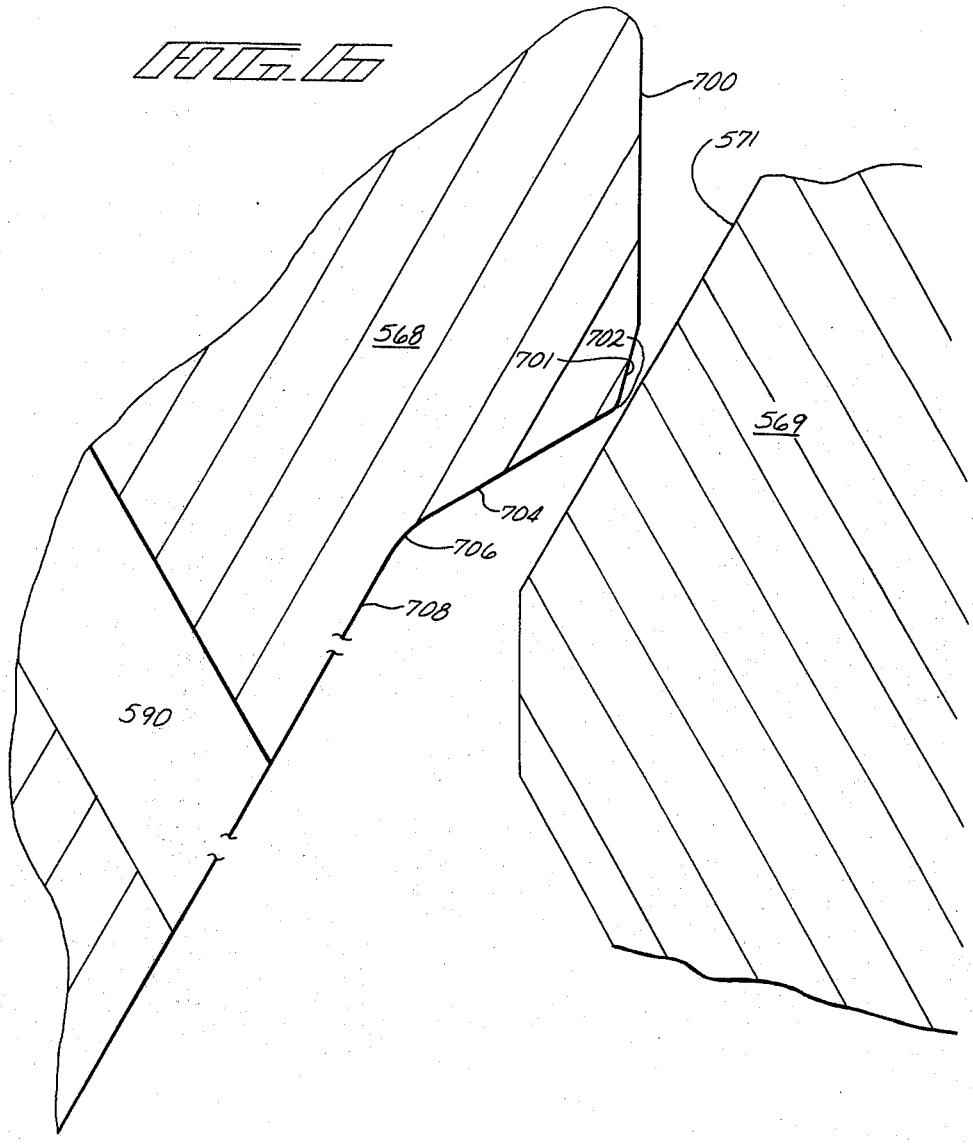
FIG. 6 is an enlarged view taken in the area of 6—6 of FIG. 5, with the valve disk spaced from the valve seat at the incipient stage of the valve being opened.

In addition to being mounted in a valve housing which can be easily removed and replaced without disturbing the solenoid housing, the valve shown in FIGS. 5 and 6 differs from that shown in FIG. 2 in another important respect. Referring to FIG. 6, which is an enlarged view taken in the area of 6—6 of FIG. 5, the valve disk includes a central cylindrical section 700, where the disk is of maximum diameter. The cylindrical section is parallel to the longitudinal axis of the valve stem and terminates at its lower end at an inwardly and downwardly extending first inclined annular surface 701, which terminates at an annular contact area 702 of the valve disk that rests on the valve seat 571. The width of the contact area is determined by the lapping process used to achieve a perfect seat between surface 702 and valve seat 571. Ordinarily, it is in the order of 0.006" to 0.012" wide. The enlarged portion of the valve disk above the contact area provides structural strength and allows room to reface the contact area, as required, and without changing the diameter of the valve disk where it rests on the valve seat. Below the contact area, the valve disk includes an annular inwardly and downwardly extending section 704, which arcs into a smooth curve at 706 to join with a third inwardly and downwardly extending annular section 708 that continues past the lateral bores 590.

As shown in FIG. 6, the first downwardly and inwardly extending annular surface 701 is inclined at an angle of about 15° from the longitudinal axis of the valve stem. The annular contact area 702 is at an angle of about 30° from the longitudinal axis of the valve stem to be parallel with the surface of valve seat 571. The third inclined area 704 is at an angle more like 50° to 60° from the longitudinal axis of the valve stem. The fourth inclined section 708 is inclined at an angle of about 30° from the longitudinal axis of the valve stem.

Having the lateral bores 590 open into the valve housing on the low-pressure side of the valve seat takes advantage of unavoidable fluid cavitation which occurs as the valve opens, i.e., with the valve disk and valve seat in the approximate position shown in FIG. 6. The relatively sharply undercut portion of the valve disk below the contact area permits a large flow as soon as the valve disk is pushed off the valve seat. Fluid flows so rapidly through the initial opening between the valve disk and seat that fluid flow lines separate from the valve disk body, causing cavitation just under the contact area. (Cavitation is a low-pressure zone caused by the inability of a fluid to remain on the contour of an object.) As the valve disk is pushed off the valve seat, high-velocity fluid flow creates a pressure zone below the contact shelf less than the low pressure existing in the annulus between the drill string and well bore. Thus, the pressure on the top of the valve stem piston is momentarily reduced, helping to diminish the force holding the valve shut so that the solenoids may fully extend with less power. As the valve disk moves further from the valve seat, cavitation decreases, but a smaller force is now required to hold the valve open once it is moved off the seat. However, the valve disk is shaped so that when held in the open position, fluid flow past it tends to force it shut, but only with a relatively low-level force, which is easily opposed by the solenoid force holding the valve open. When the solenoids are deenergized, the fluid flow force on the valve disk causes the valve to shut almost immediately. Thus, the design of the valve is such that the fluid velocity forces are moderated and used to enable low-power solenoids to operate the valve.

Since dimensions are somewhat critical to optimum operation of the valve shown in FIGS. 5 and 6, it may help to understand and practice the invention by reference to some dimensions which have proved successful in field operations. For example, if the valve disk has a diameter of about 0.780" for the straight cylindrical section 700, where the valve disk is of maximum dimension, and the contact area has a diameter of 0.755", with a compensating piston diameter of 0.750", good results have been obtained using the configuration shown in FIG. 6, where the lateral bore 590 begins about 0.17" from the contact area on the valve disk.

With the valve disk designed as shown in FIG. 6, the valve disk contact area can be lapped repeatedly, as may be required due to wear from service conditions, without having to discard the valve disk and seat. Moreover, the valve disks and seats are easily replaced, when needed, without having to dispose of the entire valve housing.

I claim:

1. In apparatus for sending information to a surface fluid-pulse detector through a drilling fluid in a borehole drilled in the earth with a drill bit on the lower end of a drill string in the borehole and through which the drilling fluid is circulated with a pump to flow through the interior of the drill string, past the drill bit, and into an annulus between the drill string and the borehole wall, the improvement comprising:

(a) means defining a passage for drilling fluid between the drill string interior and the annulus to bypass the drill bit;

(b) a valve disposed in the passage to be held in a normally closed position by the difference in drilling fluid pressure cross the valve, (c) the valve including:

(i) a valve housing with an inlet and an outlet;

(ii) a valve seat in the housing between the inlet and the outlet;

(iii) a valve disk disposed in the housing on the inlet side of the seat so the disk is urged against the seat by fluid pressure difference between the valve inlet and outlet, the disk being shaped to rest on the seat and close the valve by sealing the valve inlet from the outlet;

(iv) a valve guide chamber in the housing on the inlet side of the seat;

(v) a piston secured to move with the disk and disposed to slide in the chamber;

(vi) means connecting the chamber interior with the fluid on the outlet side of the seat when the valve is closed; and (vii) means on the valve disk for urging the valve toward a closed position when fluid passes through it so the fluid exerts a net force on the valve disk in the direction of the seat;

(d) means for applying an opening force to open the valve so drilling fluid flows through it; and (e) means for removing the force on the valve so it moves to the closed position, the opening and the closing of the valve generating a pressure pulse in the drilling fluid.

2. Apparatus according to claim 1 which includes means responsive to the flow of drilling fluid through the valve to urge it from an open toward a closed position.

3. Apparatus according to claim 1 which includes means for reducing the opening force to a holding force great enough to hold the valve open against the means urging the valve closed as drilling fluid flows through it.

4. Apparatus according to claim 1 in which the valve includes means connecting the chamber interior with fluid in the vicinity of the valve seat when the valve is opening.

5. Apparatus according to claim 1 in which the valve seat includes a generally conical surface which extends inwardly in the direction of fluid flow through the valve to where the valve seat is contacted by the valve disk when the valve is closed.

6. Apparatus according to claim 5 in which the valve seat surface is inclined at an angle of between about 5° and about 40° with respect to direction of travel of the disk as the valve is operated.

7. Apparatus according to claim 5 in which the valve disk includes a generally conical surface extending outwardly in the direction of fluid flow to where the valve disk contacts the valve seat.

8. Apparatus according to claim 7 in which the valve disk includes a generally annular surface which extends substantially perpendicular to the direction of travel of the valve disk from where the valve disk contacts the valve seat when the valve is closed.

9. Apparatus according to claim 1 which includes a fluid catcher secured to the valve disk and disposed within the valve housing on the downstream side of the valve seat.

10. Apparatus according to claim 9 in which a valve stem is secured to the valve disk and extends through the valve seat when the valve is open, the fluid catcher being secured to the valve stem.

11. Apparatus according to claim 9 in which the fluid catcher includes a generally conical surface extending outwardly in the direction of fluid flow through the valve.

12. Apparatus according to claim 10 which includes means for adjusting the position of the fluid catcher on the valve stem relative to the valve seat.

13. Apparatus according to claim 4 which includes means for applying pressure from fluid on the downstream side of the valve seat to the interior of the valve guide chamber.

14. Apparatus according to claim 13 which includes a valve stem connecting the piston to the valve disk, the piston, valve stem, and the disk having a passage therethrough to connect the interior of the valve guide chamber with fluid pressure on the downstream side of the valve seat to reduce the force on the valve disk when the valve is closed.

15. Apparatus according to claim 1 which includes a solenoid winding, a solenoid armature, a solenoid shaft secured to the armature and arranged to engage the valve disk to move the disk from the valve seat to an open position, means for applying a first large current to the solenoid winding to develop a relatively large force to open the valve, means for reducing the current to the solenoid winding to produce a smaller force which holds the valve disk in the open position, and means for de-energizing the solenoid so the valve disk returns to the valve seat and closes the valve.

16. Apparatus according to claim 15 which includes a second solenoid winding, armature, and shaft, the solenoid windings being connected to receive current simultaneously, and the solenoid shafts being aligned to exert a force simultaneously in the same direction.

17. Apparatus according to claim 15 in which the solenoid winding and armature are disposed in a chamber adapted to be filled with fluid, the armature having bores extending through it in the direction in which the armature moves to facilitate travel of the armature in the fluid.

18. Apparatus according to claim 17 in which a face of the armature contains outwardly extending grooves to facilitate fluid flow past the armature when the solenoid winding is energized.

19. Apparatus according to claim 18 in which the armature includes bores extending through it in the direction of armature travel.

20. Apparatus according to claim 1 which includes a spring urging the valve disk into the closed position when there is no flow of drilling fluid through the drill string.

21. Apparatus according to claim 15 in which the duration of the opening current is substantially less than that of the holding current.

22. Apparatus according to claim 21 in which the duration of the opening current is between about 1% and about 50% of the holding current.

23. Apparatus according to claim 15 in which the holding current is substantially less than the opening current.

24. Apparatus according to claim 23 in which the valve of the holding current is between about 1% and about 50% of the opening current.

25. In apparatus for sending information to a surface fluid-pulse detector through a drilling fluid in a borehole drilled in the earth with a drill bit on the lower end of a drill string in the borehole and through which the drilling fluid is circulated to flow through the interior of the drill string, past the drill bit, and into an annulus between the drill string and the borehole wall, the improvement comprising:

(a) means defining a passage for drilling fluid between the drill string interior and the annulus to bypass the drill bit;

(b) a valve disposed in the passage to be held in a normally closed position by the difference in drilling fluid pressure across the valve, (c) the valve including:

(i) a valve housing with an inlet and an outlet;

(ii) a valve seat in the housing between the inlet and the outlet;

(iii) a valve disk disposed in the housing on the inlet side of the seat so the disk is urged against the seat by fluid pressure difference between the valve inlet and outlet, the disk being shaped to rest on the seat and close the valve by sealing the valve inlet from the outlet and the valve disk being movable away from the seat to a position to open the valve;

(iv) a valve guide chamber in the housing on the inlet side of the seat;

(v) a piston secured to move with the disk and disposed to slide in the chamber;

(vi) means connecting the chamber interior with fluid on the outlet side of the seat when the valve is closed; and (vii) the valve disk being shaped and disposed so that when the valve is in the open position, fluid passes through the valve and exerts a force on the valve disk in the direction of the seat;

(d) means for applying an opening force to the valve disk to move the valve disk away from the seat and to open the valve so drilling fluid flows through it; and (e) means for removing the force on the valve disk so flowing fluid moves the valve disk to the closed position, the opening and the closing of the valve generating a pressure pulse in the drilling fluid.

26. In apparatus for sending information to a surface fluid-pulse detector through a drilling fluid in a borehole drilled in the earth with a drill bit on the lower end of a drill string in the borehole and through which the drilling fluid is circulated to flow through the interior of the drill string, past the drill bit, and into an annulus between the drill string and the borehole wall, the improvement comprising:

(a) means defining a passage for drilling fluid between the drill string interior and the annulus to bypass the drill bit;

(b) a valve including a valve housing in the drill string, the valve housing having an inlet and an outlet, the inlet opening into the drill string interior, and the outlet opening into the annulus;

(c) a valve seat in the valve housing between the inlet and the outlet;

(d) a valve disk disposed in the housing on the inlet side of the seat so that the disk is urged against the seat by fluid pressure difference between the valve housing inlet and outlet, the disk being shaped to rest on the seat and close the valve by sealing the valve housing inlet from the outlet;

(e) a valve stem operatively associated with the valve disk and extending away from the disk;

(f) a solenoid housing disposed within the drill string;

(g) a solenoid winding an a solenoid armature in the solenoid housing;

(h) a movable solenoid shaft operatively associated with the armature and extending from the solenoid housing to be operatively engageable with the valve stem, (i) the valve housing being constructed and arranged to be slidable relative to the drill string and to be movable into the drill string to an operating position with the valve stem operatively engageable by the solenoid shaft and out of the drill string without disturbing the solenoid housing;

(j) means for releasably locking the valve housing in the operating position in the drill string;

(k) means for energizing the solenoid winding to move the solenoid shaft and valve stem to move the valve disk off the valve seat and thereby open the valve;

(l) the valve disk being shaped and disposed when the valve is in the open position so when fluid passes through the valve, the flowing fluid exerts a closing force on the valve disk in the direction of the seat, the closing force being less than the force exerted on the valve stem by the solenoid shaft; and (m) means for decreasing the force exerted by the solenoid shaft so the force of the flowing fluid moves the valve disk to the valve seat and closes the valve, the opening and closing of the valve generating a pressure pulse in the drilling fluid.

27. Apparatus according to claim 26 in which the valve includes:

a valve guide chamber in the housing on the inlet side of the seat;

a piston secured to move with the disk and disposed to slide in the chamber;

and means connecting the chamber interior with the fluid on the outlet side of the seat when the valve is closed.

28. Apparatus according to claim 27 which includes a valve stem connecting the piston to the valve disk, the piston and valve stem having a pressure relief channel through it to connect the interior of the valve guide chamber with fluid pressure on the downstream side of the valve seat and adjacent the valve seat to reduce the force on the valve disk when the valve is closed, and reduce the force required to move the disk from a slightly opened position to a more fully opened position.

29. Apparatus according to claim 26, 27, or 28 in which the valve seat includes an annular surface which converges in the direction of fluid flow, and the valve disk includes an annular contact surface which converges inwardly in the direction of fluid flow at substantially the same angle as the valve seat annular surface, a first annular surface adjacent and upstream from the contact surface, and a second annular surface adjacent and downstream from the contact surface, the first annular surface converging in the direction of fluid flow at a rate less than that of the contact surface, and the second annular surface converging at a rate greater than that of the contact surface.

* * * * *

UNITED STATES PATENT AND TRADEMARK OFFICE

CERTIFICATE OF CORRECTION

PATENT NO. : 4,405,021

DATED : September 20, 1983

INVENTOR(S) : EDWARD S. MUMBY

It is certified that error appears in the above-identified patent and that said Letters Patent are hereby corrected as shown below:

Col. 3, line 24, "or" should read -- of --

Col. 5, line 65, "face" should read -- force --

Col. 10, line 61, "to" should read -- at --

Col. 12, line 23, "517" should read -- 571 -- line 51, "575" should read -- 574 --

Col. 13, line 63, "is" should read -- in --

Col. 16, line 12 (Claim 1, line 14), "cross" should read --across

Col. 18, line 5 (Claim 24, line 2), "valve" should read --value--

Col. 19, line 9 (claim 26, line 27), "an" should read -- and --

Signed and Sealed this

*Twenty-ninth* Day of *May 1984*

[SEAL]

*Attest:*

GERALD J. MOSSINGHOFF

*Attesting Officer*

*Commissioner of Patents and Trademarks*